United States Patent [19]

Worley et al.

[11] 3,996,063

[45] Dec. 7, 1976

[54] METHOD FOR REMOVING COKE FROM FLUID COKER OUTLETS

[75] Inventors: Arthur C. Worley, Morristown; Paul S. Fabian, Millburn, both of N.J.

[73] Assignee: Exxon Research and Engineering Company, Linden, N.J.

[22] Filed: Jan. 3, 1975

[21] Appl. No.: 538,360

[52] U.S. Cl. ..... 134/22 C; 134/30; 134/36; 134/39; 134/102; 201/2

[51] Int. Cl.[2] ..... B08B 3/00

[58] Field of Search ..... 134/22 C, 22 R, 30, 134/36, 37, 39, 95, 98, 102, 166 C; 201/2; 202/241; 208/48 R, 48 Q; 137/15

[56] References Cited

UNITED STATES PATENTS

| | | | |
|---|---|---|---|
| 2,200,668 | 5/1940 | Carlson | 134/22 R |
| 2,221,803 | 11/1940 | Krobusek | 134/102 X |
| 2,289,351 | 7/1942 | Dixon et al. | 134/22 C |
| 2,934,489 | 4/1960 | Canevari | 208/48 R |
| 3,416,598 | 12/1968 | Dorn | 208/48 R |
| 3,745,110 | 7/1973 | Allred | 201/2 X |

*Primary Examiner*—S. Leon Bashore
*Assistant Examiner*—Richard V. Fisher
*Attorney, Agent, or Firm*—Marthe L. Gibbons

[57] ABSTRACT

Coke is removed from a cyclone vapor outlet by continuously introducing a stream of relatively low pressure steam into a vapor outlet, adding a stream of high pressure steam to the low pressure stream, subsequently adding a stream of high pressure water to the high pressure steam, and discontinuing the introduction of high pressure steam. After the desired amount of coke has been removed from the outlet by thermal shocking, the introduction of high pressure water is discontinued. Thereafter, if desired, low pressure air may be introduced into the low pressure steam to control coke deposition by localized combustion.

13 Claims, 2 Drawing Figures

METHOD FOR REMOVING COKE FROM FLUID COKER OUTLETS

BACKGROUND OF THE INVENTION

1. Field of the Invention

The present invention relates to a process for the removal of carbonaceous deposits from walls of a vapor passageway. More particularly, it is concerned with the removal and control of coke deposition from the interior surfaces of a cyclone separator outlet nozzle leading to a scrubbing unit such as employed in a fluid coking process, by the application of thermal shock treatment and controlled oxidation.

2. Description of the Prior Art

Fluid coking is a well-known process, see for example U.S. Pat. No. 2,881,130. Briefly described, an oil feed is injected into a fluidized bed of solid contact particles which are usually coke particles maintained at a temperature ranging between about 850° to about 1,200° F for fuel production and up to 2,000° F for chemicals production. Although coke particles are preferred, the contact solids having a size range of 0 to 1,000 microns, such as sand, silica, mullite, etc. may be alternatively utilized.

Upon contact with the hot solids, the oil is pyrolitically converted to lighter vaporous material and a solid carbonaceous material (coke) which deposits on the contact solids. Vapors are withdrawn overhead and sent to a separation zone, generally one or more cyclone separators wherein entrained solids are removed. Vapors thereafter are passed to a scrubbing or fractionation zone for the recovery of the desired components.

Heat for the process is supplied conventionally by circulating contact particles to a burner zone wherein oxidation of carbonaceous deposits serves to heat them to supply the requisite thermal energy for the conversion step upon their recirculation to the coking reaction bed.

Typical feeds utilized in fluid coking have initial boiling points ranging from about 700° F, and an API gravity of about 0° to 20° and a Conradson carbon residue content of about 5 to about 50 weight percent.

Considerable difficulty has been encountered in the operation of cyclone separators employed to remove entrained solids. The vapors, upflowing from the reaction bed, contain heavy hydrocarbon fractions which have a tendency to condense on exposed surfaces, thereby depositing carbonaceous residues. The vapor outlet conduit of the cyclone is of considerably narrower dimensions than the reaction vessel, separation chamber or other passageway to which the coker vapors flow. Hence, there is a much greater tendency for carbonaceous deposits to build up to appreciable levels and interfere with or completely stop the normal flow of vapors. Since the cyclone outlet conduit normally serves as the vapor inlet to a quench zone, the entrance to which is approximately 200° to 300° F colder than the temperature of the reaction bed, there is a decided influence to promote condensation of heavier hydrocarbons within the passageway and the consequent deposition of coke material. The hydrocarbon conversion unit may have to be shut down to remove these coke deposits.

To overcome this difficulty, heretofore, various methods have been proposed to remove coke or minimize coke deposits in cyclone outlets. These methods include onstream methods which do not interfere with the flow of material and the conversion process as well as methods which require shut down of the unit.

To minimize or prevent condensation of vapors in the cyclone outlet, it has been proposed to increase the temperature of the cyclone outlet by various heat exchange means to minimize the condensation of vapors. Generally, such heat exchange processes have not eliminated the need for periodic coke removal. A conventionally utilized method for coke removal comprises inserting a water lance through the scrubber vessel shell for each cyclone when decoking is required. During insertion and retraction of the lance, a packing gland is required and the vessel shell is venerable to thermal shock by misdirected water. The shocking of the scrubber shell by water can cause shell cracking.

It is known to use a mixture of steam and an oxygen-containing gas to remove carbon from pipes or retorts (see, for example, U.S. Pat. No. 49,989 and U.S. Pat. No. 1,470,359).

It is also known to spall coke from vessel walls by hydraulic means, such as streams of high pressure water (see, for example, U.S. Pat. No. 3,745,110).

The present invention sets forth a process and apparatus for decoking and limiting or preventing the concentration of residue in a cyclone vapor outlet without substantially interfering with the normal flow of vapor materials or the operation of the conversion reaction.

SUMMARY OF THE INVENTION

In accordance with the invention there is provided, a decoking process which comprises (a) continuously flowing a stream of low pressure steam in a confined path; (b) introducing said stream into a vapor outlet passage; (c) introducing a stream of high pressure steam into said path of step (a); (d) introducing gradually a stream of high pressure water into said path of step (a); and (e) discontinuing the introduction of said high pressure steam into said path. After the introduction of high pressure water is discontinued, low pressure air may be introduced into the low pressure steam to control coke deposition.

Furthermore, the present invention provides a decoking apparatus which comprises a nozzle having at one end an outlet in communication with a vapor outlet passage; a conduit connected at the other end of said nozzle, and means connected to said conduit for introducing separate fluid streams into said conduit.

Thus, the process and apparatus of the invention minimize the possibility of thermal shock cracking of the vessel shell since there is no direct impingement of water on the pressure vessel shell because the water is introduced directly into the cyclone vapor outlet. Furthermore, the present invention teaches a simple means for periodically removing carbonaceous deposits without stopping normal hydrocarbon conversion operation.

DESCRIPTION OF THE PREFERRED EMBODIMENTS

Figure 2:
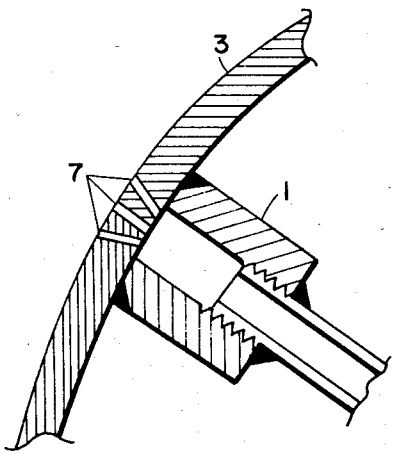
FIG. 2 is a vertical section taken along line I—I of FIG. 1.
Figure 1:
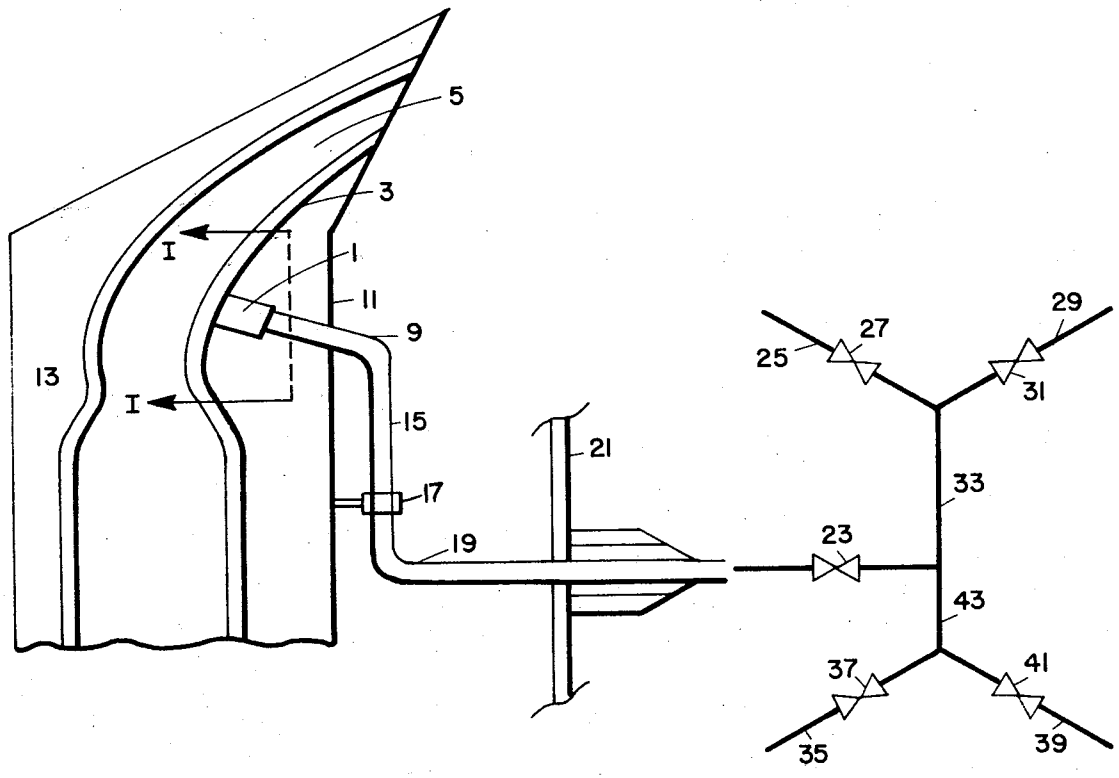
FIG. 1 is a schematic elevation view of a cyclone outlet and decoking device in which the process of the present invention may be carried out.

Referring to the accompanying figures, wherein like parts are referred to by the same numerals, there is shown a decoking and coke control device, in accordance with the present invention, which includes an open, enlarged end 1 of a conduit operatively connected to an external wall 3 of an end portion (snout) of a cyclone outlet conduit and in open communication with the interior 5 of the snout by means of one or more holes drilled through the snout wall to form annular conduits 7 (as shown in FIG. 2) which can function as a nozzle through which one or more streams of fluids can be injected into the snout. These annular conduits defined by the snout wall will be referred to collectively herein as "nozzle." The enlarged end portion 1 is connected to conduit 9 which passes transversely through a wall 11 of a conventional thermal insulation retainer box of metallic construction disposed around cyclone outlet conduit 13. Conduit 9 is connected to a vertical conduit 15 which is disposed in spaced relation to insulation retainer box wall 11 by conventional means such as bracket 17 and hangers. Conduit 15 is connected to a horizontally disposed conduit 19 which passes through scrubber vessel wall 21 to the exterior of the scrubber vessel. The scrubber vessel is mounted directly on top of a conventional fluid coking reactor (not shown). A valve 23 is disposed in conduit 19. Fluid inlet conduits, each including at least one valve, are connected to conduit 19. These inlet conduits may be disposed as shown in FIG. 1, for example, conduit 25 having disposed therein valve 27, and line 29 having disposed therein valve 31 discharge into line 33, which in turn is connected to line 19. Line 35 having disposed therein valve 37, and line 39 having disposed therein valve 41 discharged into line 43 which in turn is connected to conduit 19. The valve of inlet conduits 25, 29, 35 and 39 can operate such as to permit flow of fluid out of only one conduit or flow of fluid simultaneously out of any combination of these conduits or flow of fluids simultaneously out of all the conduits. It should be noted that the inlet conduits can be connected to line 19 in any suitable manner that will permit either separate or combined injection of one or more fluid streams into the conduit that is connected to the nozzle. Furthermore, instead of conduits designated as 9, 15 and 19, a single conduit could be utilized. Although the vapor outlet shown in FIG. 1 is a convergent snout, the device of the invention is equally suitable for use with non-tapered or divergent snouts or outlet passages.

The process for decoking and coke control utilizing the device shown in FIG. 1 operates as follows:

Relatively low pressure steam, for example, at 150 pounds per square inch gauge (psig) is introduced continuously into line 39. The low pressure steam flows through line 43 into lines 19, 15, 9, 1 and then into the nozzle from which it exits into the interior 5 of cyclone outlet snout. The exit velocity of the low pressure steam into the outlet ranges from about 10 feet per second to about 100 feet per second. This low pressure steam flow is provided continuously through the nozzle as purge to keep the orifices open. Suitable low pressure range of steam charged to inlet conduit 39 ranges from about 50 psig to about 150 psig. This low pressure steam is fed into the nozzle at a rate which ranges generally from about 10 pounds per hour to about 50 pounds per hour; for example, 17 pounds per hour. When the pressure differential across the outlet snout has reached a predetermined level which indicates the need for removal of coke deposition, the coke removal process is initiated by introducing a stream of high pressure steam, for example, at 600 psig into line 29, then through line 33 to mix with the low pressure steam which flows through lines 19, 15, 9 and 1 into the nozzle. The mixed stream emerges from the nozzle into the snout at an exit velocity ranging from about 50 feet per second to about 300 feet per second. Suitable range of high pressure steam for introduction ranges from about 150 psig to about 700 psig.

After a high pressure steam flow has been established, a stream of high pressure water, for example, at about 1,000 psig carried in line 25 is permitted to flow gradually into line 33 to mix with the high pressure steam and hence to the various conduits into the nozzle. This gradual addition decreases the possibility of thermal shock effects on the conduits. The combined stream emerges from the nozzle at an exit velocity in the range from about 100 feet per second to about 500 feet per second. Suitable range of high pressure water conducted in line 25 includes a pressure ranging from about 200 psig to about 5,000 psig.

When full water flow has been reached, the flow of high pressure steam is discontinued. The exit velocity of the combined low pressure steam and high pressure water in the outlet ranges from about 100 feet per second to about 500 feet per second. The flow of high pressure water is continued until the desired degree of coke removal by thermal spalling has been completed as evidence by reduction or elimination of pressure differential across the snout, for example, by utilizing a method for detecting coke buildup as described in U.S. Pat. No. 3,592,762. Subsequently, if desired, to control coke deposition in the snout, a low pressure stream of an oxidizing gas, such as air carried in line 35 is permitted to flow into line 43 and then through line 19 where it will mix with the continuous low pressure steam which flows from line 39 through lines 43, 19 and 1. The mixture of low pressure steam and low pressure air emerges from the nozzle into the snout. In the snout, the air reacts with carbonaceous matter to form carbon oxides. The exothermic heat of reaction will increase the temperature of the snout wall and thereby help in inhibiting the condensation of a portion of the vapors which pass through the cyclone outlet snout. Condensation of these vapors eventually lead to coke formation from the condensed material. Suitable low pressure range of air carried in line 35 ranges from about 50 psig to about 150 psig. The exit velocity of the combined low pressure steam-air mixture which emerges from the nozzle for coke control ranges from about 50 feet per second to about 200 feet per second. When it is desired to initiate the coke removal stage, the air flow into the snout is discontinued so that only the low pressure steam continues to flow through the nozzle. The already described sequence of adding the high pressure steam to the low pressure steam is then repeated.

Although only one decoking device has been shown, more than one such decoking device could be used in conjunction with one cyclone outlet. Furthermore, more than one cyclone each having one or more decoking devices could be employed in conjunction with a fluid coking reactor.

What is claimed is:

1. A decoking process for removing coke from a vapor outlet passage for products from a coking process, said decoking process being conducted while said coking process is in operation, which comprises:

a. continuously flowing a stream of relatively low pressure steam in a confined path;

b. introducing said stream into said vapor outlet passage;

c. introducing a stream of high pressure steam into said path of step (a), and passing the combined streams of steps (a) and (c) into said vapor outlet passage;

d. introducing gradually a stream of high pressure water into said path of step (a), and passing the combined streams of steps (c) and (d) into said vapor outlet passage;

e. discontinuing the introduction of said high pressure steam into said path when full water flow has been reached, and f. continuing the flow of said high pressure water into said path and passing the resulting stream into said vapor outlet passage for a time sufficient to remove by thermal spalling at least a portion of said coke from said vapor outlet passage.

2. The process of claim 1, wherein said low pressure steam of step (a) ranges from about 50 to about 150 psig.

3. The process of claim 1, wherein said high pressure steam of step (c) ranges from about 150 psig to about 700 psig.

4. The process of claim 1, wherein the pressure of said high pressure water of step (d) ranges from about 200 psig to about 5,000 psig.

5. The process of claim 1, wherein the exit velocity of said low pressure steam of step (b) into said outlet passage ranges from about 10 feet per second to about 100 feet per second.

6. The process of claim 1, wherein after the introduction of said high pressure steam is discontinued, the exit velocity of the combined low pressure steam and high pressure water in said outlet passage ranges from about 100 feet per second to about 500 feet per second.

7. The process of claim 1, wherein after step (f) the introduction of high pressure water is discontinued and wherein low pressure air is introduced into said path of step (a) and passing the combined streams of low pressure steam and low pressure air into said vapor outlet passage.

8. The process of claim 7, wherein the pressure of said air introduced into said path ranges from about 50 psig to about 150 psig and wherein the exit velocity of the combined stream of low pressure steam and air in said outlet passage ranges from about 50 feet per second to about 200 feet per second.

9. The process of claim 7, wherein said air is introduced into said path in an amount sufficient to effect an increase in the temperature of said outlet passage.

10. The process of claim 1, wherein said outlet passage is the vapor outlet of a cyclone separator.

11. The process of claim 10, wherein at least a portion of said cyclone separator is positioned in a fluid coking reactor.

12. A decoking process for removing coke from a cyclone vapor outlet of a fluid coking reactor, said decoking process being conducted while said fluid coking reactor is in operation, which comprises:

a. continuously flowing a stream of low pressure steam in a conduit, said conduit being connected to a nozzle and said nozzle having an outlet orifice operatively connected to said cyclone vapor outlet;

b. introducing said low pressure steam into said cyclone vapor outlet through said nozzle;

c. introducing a stream of high pressure steam into said stream of low pressure steam to form a combined stream in said conduit and passing said combined stream into said cyclone vapor outlet through said nozzle;

d. introducing gradually a stream of high pressure water into said combined stream in said conduit, and passing the combined streams of steps (c) and (d) into said cyclone vapor outlet through said nozzle;

e. discontinuing step (c) when full water flow has been reached, and f. continuing the flow of said high pressure water into said conduit and passing the resulting stream into said cyclone vapor outlet through said nozzle for a time sufficient to remove by thermal spalling at least a portion of said coke from said cyclone vapor outlet.

13. The process of claim 12 wherein after the introduction of said high pressure steam is discontinued, the exit velocity of the combined low pressure steam and high pressure water in said cyclone water vapor outlet ranges from about 100 feet per second to about 500 feet per second.

* * * * *